US012006603B2

(12) United States Patent
Laune et al.

(10) Patent No.: US 12,006,603 B2
(45) Date of Patent: Jun. 11, 2024

(54) SYSTEM FOR FORMING A FIBRE BATT

(71) Applicant: ANDRITZ ASSELIN-THIBEAU, Elbeuf (FR)

(72) Inventors: Jean-Christophe Laune, La Londe (FR); Wael Jabri, Saint Cloud (FR)

(73) Assignee: Andritz Asselin-Thibeau, Elbeuf (FR)

( * ) Notice: Subject to any disclaimer, the term of this patent is extended or adjusted under 35 U.S.C. 154(b) by 252 days.

(21) Appl. No.: 16/427,403

(22) Filed: May 31, 2019

(65) Prior Publication Data

US 2019/0368088 A1 Dec. 5, 2019

(30) Foreign Application Priority Data

May 31, 2018 (FR) ..... 18 70626

(51) Int. Cl.
*D04H 1/02* (2006.01)
*D04H 1/70* (2012.01)

(52) U.S. Cl.
CPC ..... *D04H 1/02* (2013.01); *D04H 1/70* (2013.01)

(58) Field of Classification Search
CPC .. D04H 1/02; D04H 1/70; D04H 1/72; D04H 5/08; D04H 17/00; D01G 25/00; D01G 23/00; D01G 15/10
See application file for complete search history.

(56) References Cited

U.S. PATENT DOCUMENTS 6,141,833 A * 11/2000 Sorensen ..... D01G 25/00 19/161.1
6,195,844 B1 * 3/2001 Jourde ..... D01G 15/46 19/163
6,405,417 B1 * 6/2002 Sheehan ..... G03G 15/657 28/107
6,550,107 B1 * 4/2003 Jourde ..... D01G 25/00 19/161.1

(Continued)

FOREIGN PATENT DOCUMENTS

EP 1 285 982 A1 8/2002 ..... D01G 25/00
EP 1 589 132 A1 4/2004 ..... D01G 15/46

(Continued)

OTHER PUBLICATIONS

Search Report dated Feb. 12, 2019 in related application No. FR 1870626.

*Primary Examiner* — Bao-Thieu L Nguyen
(74) *Attorney, Agent, or Firm* — Renner, Kenner, Greive, Bobak, Taylor & Weber

(57) ABSTRACT

A facility for forming a fibre batt, in particular nonwoven, provides a device for producing at least one fibre web, and a crosslapper which provides the fibre batt. The production device provides a carding drum and at least one doffer roller collecting the fibres on the drum and supplying the at least one web to at least one outfeed belt. The crosslapper provides an infeed belt for the introduction of the web in the crosslapper, which supplies the fibre batt formed of a stack of layers of the at least one web, and first control means of (Continued)

the profile of the thickness and/or of the area bulk density and/or of the bulk density of the web or of each web. A drafting means is arranged downstream of the outfeed belt of the production device and upstream of the infeed belt. Second control means may be provided to control drafting means.

16 Claims, 3 Drawing Sheets

(56) References Cited

U.S. PATENT DOCUMENTS 6,662,407 B2 * 12/2003 Bernhardt ..... D01G 25/00 19/161.1
6,732,412 B2 * 5/2004 Collotte ..... D01G 15/465 19/296
2003/0033691 A1 * 2/2003 Bernhardt ..... D04H 1/74 19/105
2004/0026012 A1 * 2/2004 Kato ..... D04H 1/43835 156/180
2005/0022343 A1 * 2/2005 Bernhardt ..... D01G 15/465 19/98
2006/0010653 A1 * 1/2006 Duda ..... D01G 15/46 19/98
2013/0251839 A1 * 9/2013 Schwarz ..... D04H 1/732 425/329
2014/0202494 A1 * 7/2014 Latten ..... D01G 15/10 134/6
2015/0196145 A1 * 7/2015 Reuben ..... B05D 3/0254 427/389.9
2015/0251867 A1 * 9/2015 Higuchi ..... B65H 20/10 226/95
2016/0145801 A1 * 5/2016 Fujita ..... B65H 20/06 162/289
2016/0273141 A1 * 9/2016 Meier ..... D01G 25/00
2017/0088358 A1 * 3/2017 Dilo ..... B65G 21/2063
2018/0355128 A1 * 12/2018 Yoshikawa ..... D04H 1/74
2019/0271102 A1 * 9/2019 Laune ..... D04H 1/74
2020/0101637 A1 * 4/2020 Yoda ..... D04H 1/732
2020/0149199 A1 * 5/2020 Niklaus ..... D04H 1/56

FOREIGN PATENT DOCUMENTS

EP 2 085 504 A1 2/2008 ..... D01G 15/46
WO WO 02/101130 A1 12/2002 ..... D01G 25/00

* cited by examiner

SYSTEM FOR FORMING A FIBRE BATT

TECHNICAL FIELD

The present invention relates to a facility or system for forming a fibre batt, in particular a nonwoven batt, comprising a device for producing at least one fibre web, in particular nonwoven, and a crosslapper fed, at its entrance, by the at least one fibre web coming from the production device and supplying, at its exit, a fibre batt made of a stack of the fibre web(s).

BACKGROUND ART

In the prior art, a facility of the type named above is already known from WO99/24650, from the applicant. The facility comprises a card producing, by means of two doffers each collecting fibres from the carding drum, two elementary webs of fibres supplied to two respective outfeed belts and then laid over one another to form a fibre web placed on an infeed belt of a crosslapper, the latter stacking, according to a back and forth movement, the fibre webs on themselves to supply, at the exit, a fibre batt made of several layers of fibre webs. Moreover, means are provided for ordering the lateral profile or distribution of the area density of the batt upstream of the outfeed belts, this profile or distribution subsequently travelling in the line in order to achieve, at the exit of the crosslapper, a web having a lateral profile in the desired lateral direction (CD) in advance, in particular as homogeneous as possible, for example a constant, or substantially constant, area density, or a thickness/area density/bulk density profile as an inverted U shape, to counter the future effects of needling-punching.

Although the prior art facility described above gives good results, in particular by making it possible to obtain a lateral profile which corresponds well to that desired in advance of the batt exiting the crosslapper, for example by making it possible to obtain a very homogeneous batt, the desire is to improve the system, in particular reducing overspeeds (peak speeds in respect of mean speed) and/or the maximum acceleration entering and/or exiting the crosslapper for the same production speed of the batt or increasing this production speed without the overspeeds and/or the maximum acceleration entering and/or exiting the crosslapper increasing.

SUMMARY OF THE INVENTION

According to a first feature of the invention, a facility for forming a fibre batt, in particular a nonwoven, comprising a device for producing at least one fibre web, in particular at least one nonwoven web, and a crosslapper supplied to the at least one fibre web(s) for providing, at the exit of the fibre batt, the production device comprising a carding drum and at least one doffer roller collecting fibres on the carding drum and supplying the at least one web to at least one outfeed belt, the crosslapper having an infeed belt, on which the at least one web is placed for its introduction into the crosslapper, the latter supplying at the exit the fibre batt formed of a stack of layers of the at least one web, and first control means of the profile of the thickness and/or of the area density and/or the bulk density of the web or of each web according to a law of variation as a function of time, in particular periodically, into a point of the path of the web or each web in the web production device upstream of the or each infeed belt, is characterised by drafting means arranged downstream of the or each outfeed belt of the web production device and upstream of the infeed belt of the crosslapper, in particular directly upstream of the infeed belt of the crosslapper, second control means being provided to control the drafting means so as to cause variation in the drafting as a function of time, in particular periodically, the actions of the first and second control means being synchronised.

Thus by providing for a combination of an action to provide variation as a function of time, the lateral thickness profile and/or the area density profile and/or the bulk density profile of the web or of each web inside the web production device itself to a drafting action likewise variable downstream of the production device but before introduction into the crosslapper, it is possible, as a function of the intrinsic geometric data of the facility (in particular the acceleration distance, the unwound length of the card and the unwound length of the crosslapper and the size of the batt desired at the exit) to regulate, by synchronising the two actions, to an optimal value the distribution (x and 100%-x) of the influence of each of the two actions (variation of the profile at a point inside the card and variation of the drafting outside of the card) so as to reduce the maximum accelerations and overspeeds created in the crosslapper for an identical production speed, or increase this production speed for an identical maximum acceleration and the same overspeeds created in the line. Moreover, the facility according to the invention is particularly well suited to batts comprising fibres which are difficult to draft.

According to a very advantageous embodiment of the invention, the first control means control the relative rotation speed of the or each doffer in respect of the carding drum.

Preferably, the relative movement speed of the or each outfeed belt in respect of the drum is synchronised with the peripheral speed of the or each doffer, in particular is equal or substantially equal to the peripheral speed of the or each doffer.

In particular, the device for forming the at least one web comprises, in addition to the carding drum and the doffer roller(s), one or more condenser rollers and one or more stripping rollers, and their rotational speed is synchronised with that of the doffer(s) and with that of the outfeed belt(s).

According to a particularly preferred embodiment, the drafting means are made of a drafting roller, the rotational speed of which is controlled in order to achieve variation in drafting.

According to a preferred embodiment, the arrangement is such that the path of the at least one web between an outfeed belt of the web forming device, downstream of the doffer(s), and the infeed belt of the crosslapper comprises at least one inflection point.

According to a preferred embodiment, the drafting means comprise a drive element, for example a drafting roller, of the at least one web comprising a drive surface intended to come into contact with the at least one web for driving same, the speed of the drive element being controlled in order to achieve variation of the drafting, and a suction device for achieving suction at the drive surface is provided in order to maintain, by suction, the at least one web against the drive surface during drafting.

According to another embodiment, the drafting means comprise a drive element, for example a drafting roller, of the at least one web comprising a drive surface intended to come into contact with the at least one web for driving same, the speed of the drive element being controlled to achieve variation of the drafting, and pinching means, in particular in two pinching points, are provided in order to maintain the at least one web against the drive surface during drafting.

According to a preferred embodiment, two outfeed belts of the web forming device are provided, respectively upper and lower, the two upper and lower webs converging upstream of the drafting means, in particular upstream of the drafting roller.

In particular, one or each outfeed belt of the web forming device is inclined in respect of the infeed belt of the crosslapper.

In particular, the outfeed end point of the or each outfeed belt of the web forming device is staggered in terms of height in respect of, in particular is above, the infeed end point of the infeed belt of the crosslapper.

According to an embodiment, at the exit of the return roller of the upper belt, the upper web comes into contact with the outer surface of the drafting roller and moves along this outer surface to the return roller of the infeed belt of the crosslapper.

Preferably, the proportion of each of the two actions on the profile of the batt exiting the crosslapper, i.e. the variation on the profile into a point inside the web forming device and drafting in a point outside, upstream of the infeed belt of the crosslapper, is between 20%-80% and 80%-20%, in particular between 30%-70% and 70%-30%.

According to a feature of the invention, independent of the first feature above, but capable, preferably, likewise of being implemented in combination with this first feature, a facility for forming a fibre batt, in particular nonwoven, comprising a device for producing at least two elementary fibre webs, in particular nonwoven, and a crosslapper supplied in a fibre web made by overlaying the at least two elementary fibre webs in order to provide at the exit the fibre batt, the production device comprising a carding drum and at least two doffer rollers collecting fibres on the carding drum and supplying the at least two elementary webs to at least two respective outfeed belts, the crosslapper having an infeed belt, on which the web is placed for the introduction thereof into the crosslapper, the latter supplying, at the outside of the fibre batt formed of a stack of layers of the web, and first control means of the relative rotational speed of each doffer in respect of that of the carding drum being provided thus to be able to vary the profile of the thickness and/or of the area bulk density and/or of the bulk density of the batt exiting the crosslapper.

BRIEF DESCRIPTION OF THE DRAWINGS

Solely by way of example, a preferred embodiment of the invention is described with reference to the drawing, in which.

DETAILED DESCRIPTION OF THE INVENTION

Figure 1:
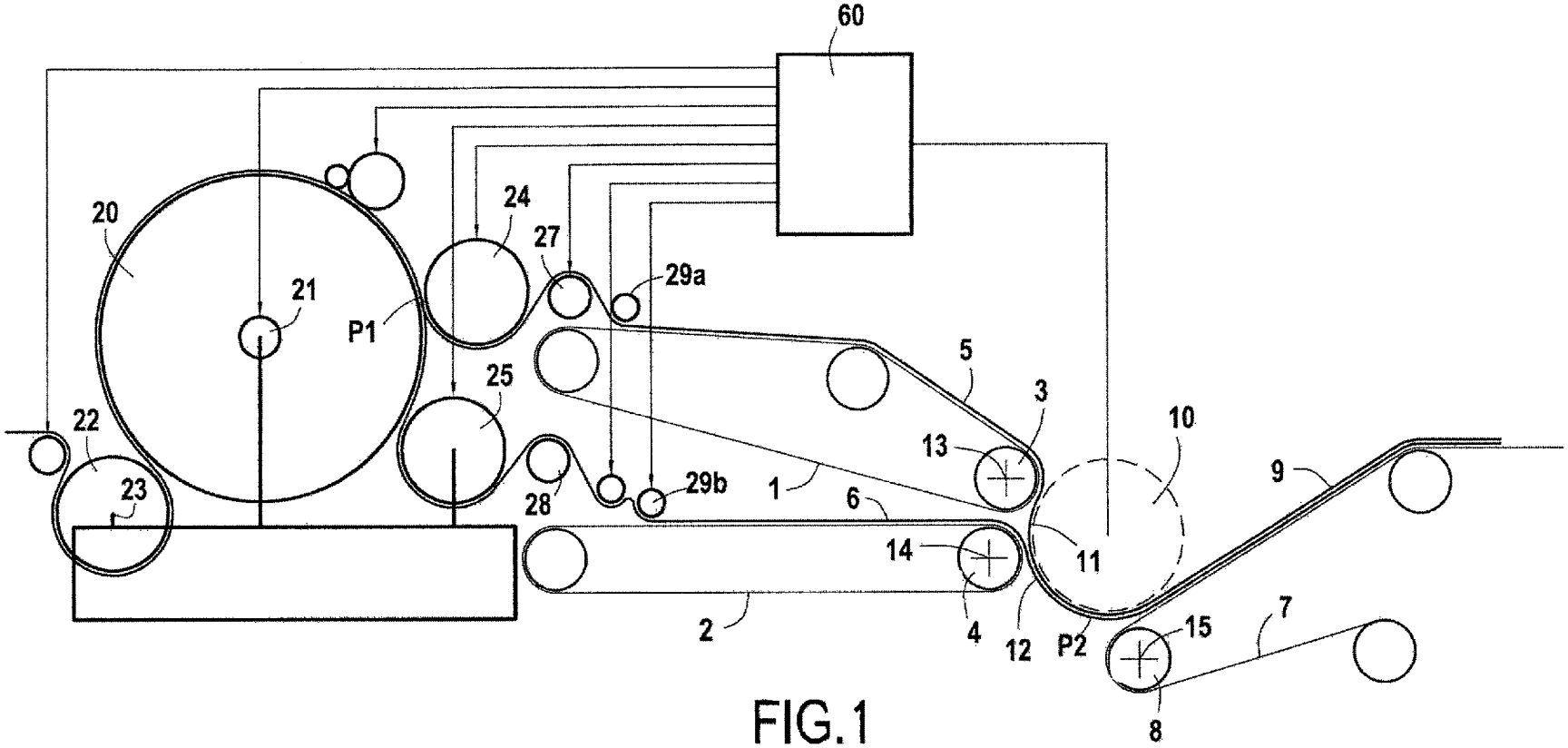
FIG. 1 represents, schematically, a facility according to the invention.

In FIG. 1, a card facility produces two elementary nonwoven webs 5, 6 exiting the card facility by two belts 1 and 2 for exiting the card, respectively upper and lower. Upper and lower card outfeed belts 1 and 2 each comprise a respective return roller 3 and 4 rotating at a substantially identical and constant speed. The two elementary webs 5 and 6 corning from the two card outfeed belts 1 and 2 are channelled towards the crosslapper infeed belt 7 itself having a return roller 8.

The nonwoven web 9 formed by the gathering of the two elementary webs 5 and 6 is then rolled in the crosslapper in the form of lateral sections towards one another by a lapper carriage in order to form a nonwoven web at the exit of the crosslapper.

The crosslapper and the two elementary webs are laid over one another between the two card outfeed belts 1 and 2 and infeed belt 7 of the crosslapper, before passing over a rotating drafting roller 10 by a motor controlled by a control system to modify the rotational speed of the drafting roller 10 in order to draft, more or less, the web 9 as necessary.

Return rollers 3 and 4 of the two card outfeed belts rotate substantially at the same speed, whereas drafting roller 10 rotates at a variable peripheral speed, equal to or greater than that of card outfeed belts 1 and 2, in order thus to achieve drafting of the web 9. Infeed belt 7 advances at a speed which is substantially equal to that of drafting roller 10. However, it is likewise possible to apply a slight drafting (in particular from 1 to 10%) between roller 10 and infeed belt 7, the tension introduced by this auxiliary drafting increasing the adhesion of the web on the roller 10.

The journey of upper web 5 between upper outfeed belt 1 and crosslapper infeed belt 7 is such that it passes over a part of the outer surface of roller 10. Moreover, the arrangement is achieved such that an inflection point 11 is formed between outfeed roller 3 of outfeed belt 1 and infeed roller 8 of infeed belt 7 of the crosslapper.

Similarly, an inflection point 12 is formed for the lower web 6 of lower outfeed belt 2, between outfeed roller 4 of outfeed belt 2 and infeed roller 8 of infeed belt 7 of the crosslapper. However, according to another embodiment, only one inflection point for the upper web 5, but not for lower web 6, could be provided.

According to another possible embodiment, in addition to or instead of the assembly at the inflection point, it can be provided that roller 10 is in suction mode.

As seen in the figure, each outfeed belt 1 and 2 is inclined in respect of the infeed belt 7 of the crosslapper. The end point of the exit of each belt 1 and 2 is offset in terms of height in respect of, in particular is above, the end point of the entry of the infeed belt 7 of the crosslapper. Rollers 3, 4 at the end or return of each outfeed belt, in particular their respective axes 13, 14, are arranged offset in terms of height in respect of, in particular above, end or return roller 8 of the infeed belt of the crosslapper, in particular in respect of its axis 15.

At the exit of roller 3, upper web 5 comes into contact with the outer surface of roller 10 and moves along this outer surface as far as infeed belt 8 of the crosslapper.

At the exit of the roller 4, web 6 comes into contact with upper web 5, itself in contact with the outer surface of roller 10 and moves, with web 5, along this outer surface up to infeed belt 8 of the crosslapper.

The interstice between roller 10 and roller 3 is greater than the sum of the thicknesses of belt 1 and web 5, such that there is no pinching force exerted on web 5 in terms of this interstice.

The interstice between roller 10 and roller 4 is greater than the sum of the thicknesses of belt 2, web 5 and web 6, such that there is no pinching force exerted on the two webs 5 and 6 in terms of this interstice.

The interstice between roller 10 and roller 8 is greater than the sum of the thicknesses of belt 7 and web 9, such that there is no pinching force exerted on web 9 in terms of this interstice.

Figure 4:
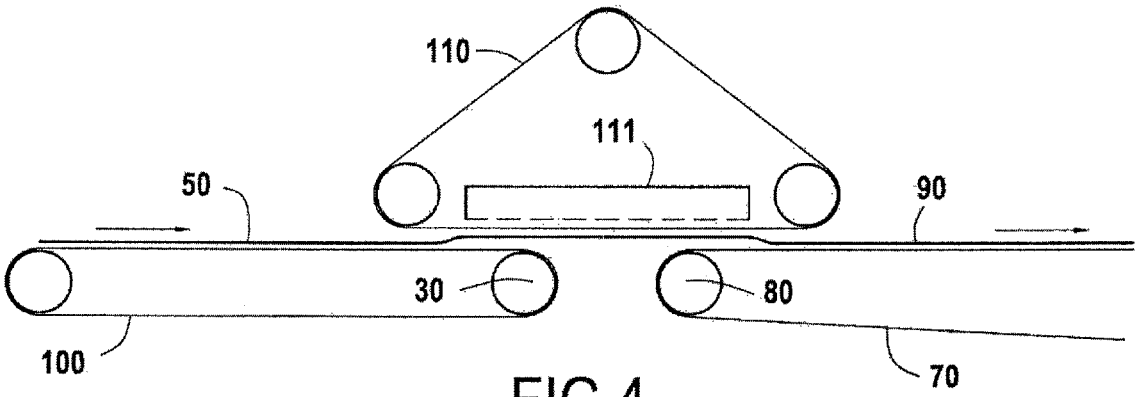
FIG. 4 represents, schematically, a part of a facility according to yet another embodiment.

According to the embodiment shown, a drafting device is provided in the form of a cylindrical roller. However, it would be possible to provide an element in any other geometric form, since it is important to form a contact surface with web 5 in order to guide same between roller 3 and roller 8 by drafting the web 5. For example, as shown in FIG. 4, it would be possible to provide a continuous belt 110 with a straight portion extending between the two rollers 3 and 8.

The portion of belt 1 in front of return roller 3 is inclined towards the bottom in the direction of roller 3, whereas the portion of belt 7 is inclined in the other direction, i.e. towards the top of return roller 8.

The portion of belt 2 in front of return roller 4 is substantially horizontal.

The interstice between roller 10 and roller 3 is greater than the sum of the thicknesses of belt 1 and web 5, such that there is no pinching force exerted on web 5 in terms of this interstice. In particular, this interstice can be between 5 and 20 mm, for example between 7 and 15 mm, for a web area density of between 10 and 50 g/m$^2$, preferably between 20 and 40 g/m$^2$.

The interstice between roller 10 and roller 4 is greater than the sum of the thicknesses of belt 2, web 5 and web 6, such that there is no pinching force exerted on the two webs 5 and 6 in terms of this interstice. In particular, this interstice can be between 10 and 30 mm, for example between 15 and 25 mm, for a web area density of between 10 and 50 g/m$^2$, preferably between 20 and 40 g/m$^2$.

The interstice between roller 10 and roller 8 is greater than the sum of the thicknesses of belt 7 and web 9, such that there is no pinching force exerted on web 9 in terms of this interstice.

Figure 2:
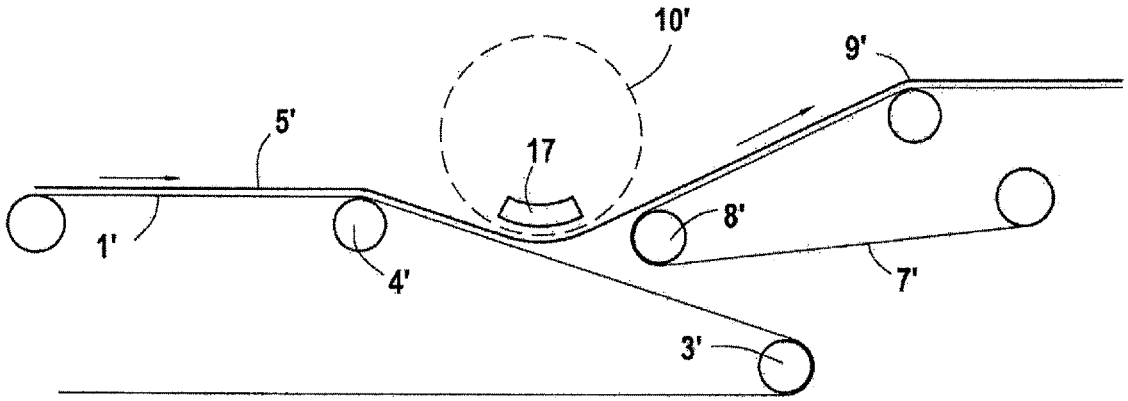
FIG. 2 represents, schematically, a part of a facility according to another embodiment.
Figure 3:
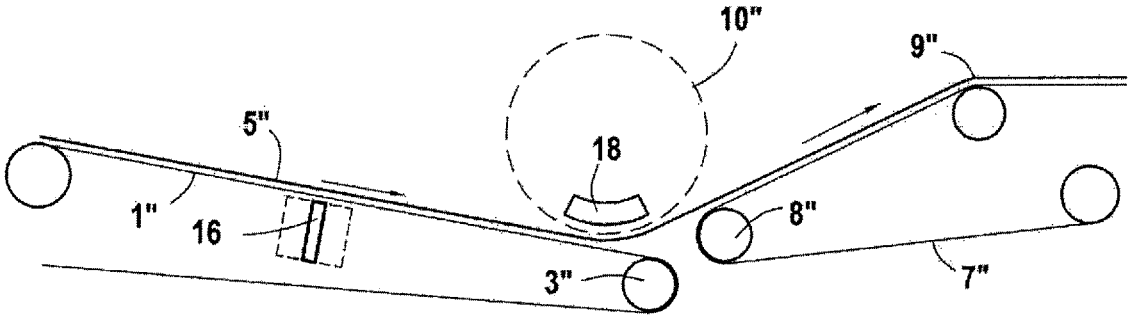
FIG. 3 represents, schematically, a part of a facility according to yet another embodiment.

According to the embodiment shown in FIGS. 1, 2 and 3, a drafting device in the form of a cylindrical roller has been provided. However, an element in any other form could be provided, since it is important to form a drive surface in contact with web 5 in order to guide same between roller 3 and roller 8 by drafting the web 5. For example, as shown in FIG. 4, it is possible to provide a continuous belt having a straight portion extending between the two rollers 3 and 8.

The portion of belt 1 in front of return roller 3 is inclined towards the bottom in direction of roller 3, whereas the portion of belt 7 is inclined in the other direction, i.e. towards the top proceeding from return roller 8.

The portion of belt 2 in front of return roller 4 is substantially horizontal.

FIG. 2 shows a different embodiment of a facility according to the invention. The elements having the same function as in FIG. 1 are given the same reference numbers with the addition of '.

A card produces a web 5' of nonwoven fibres exiting the card by a card outfeed belt 1'. Card outfeed belt 1' comprises a return roller 3' rotating at a substantially constant speed. Web 5' which has come from the card is guided towards crosslapper infeed belt 7', itself having a return roller 8'.

Web 5' is then processed in the crosslapper, and in particular rolled in the form of lateral sections, one towards the other, in order to form a nonwoven web when exiting the crosslapper.

The web is transported between card outfeed belt at 1' and crosslapper infeed belt 7' by a drafting roller 10' rotated by a motor controlled by a control system for modifying the rotational speed of drafting roller 10' for drafting more or less the card web as needed, and in particular to regulate the lateral thickness profile of the batt formed at the exit of the crosslapper.

Return roller 3' of the card belt rotates substantially at a constant speed, whereas drafting roller 10' has a variable peripheral speed as a function of time, in particular periodically, which is greater than that of card outfeed belt 1', in order thus to achieve a drafting of web 5', the drafted web entering into the crosslapper numbered 9' in FIG. 2. Infeed belt 7' moves forward at a speed substantially equal to that of drafting roller 10'. However, it is likewise possible to provide application of a slight drafting (from 1 to 10% in particular) between roller 10' and infeed belt 7', the tension caused by this auxiliary drafting increasing the control of the web during transfer from roller 10' to belt 7'.

The path of the web 5' between upper outfeed belt 1' and crosslapper infeed belt 7' is such that it passes over a portion of the lower surface of roller 10', in particular over an angle sector of between 60° and 100°.

Roller 10' is in suction mode for helping web 5' to be guided between roller 4' and infeed belt 7' and to maintain same against the surface of roller 10' during drafting. In order to do this, a suction sector 17 linked to a ventilator, which is not shown, achieves the depression inside roller 10' in order to obtain the necessary depression to keep web 5' against the lower surface of roller 10'. The suction sector 17 and its associated ventilator are arranged such that the thickness of web 5' passing over the surface of roller 10' is not less than 50% of the thickness of web 5' directly upstream of the roller, preferably is not less than 75% of its thickness directly upstream of the roller, preferably is not less than 90%, even more preferably is substantially equal to the thickness directly upstream of the roller and even more preferably is equal to its thickness directly upstream of roller 10'. In particular the suction sector 17 and its associated ventilator are dimensioned in order to create, for a web density area of between 20 and 100 g/m$^2$, in particular between 40 and 80 g/m$^2$, a depression of between 5 millibars and 100 millibars, in particular of between 5 and 50 millibars.

At the exit of roller 4', web 5' comes into contact with the lower surface of roller 10' and moves along this surface towards the infeed belt 7' of the crosslapper.

The interstice between roller 10' and belt 1' is greater than the thickness of web 5', such that no pinching force is exerted on web 5' in terms of this interstice. In particular, this interstice can be between 5 and 20 mm, for example between 7 and 15 mm for a web density area of between 10 and 50 g/m$^2$, preferably between 20 and 40 g/m$^2$.

The interstice between roller 10' and roller 8' is greater than the thickness of web 9', such that there is no pinching force exerted on web 9' in terms of this interstice.

FIG. 3 shows a third embodiment of a facility according to the invention. The elements having the same function as in FIG. 1 are given the same reference numbers with the addition of ".

A card produces a web 5" of nonwoven fibres exiting the card by a card outfeed belt 1". Card outfeed belt 1" comprises a return roller 3" rotating at a substantially constant speed. Web 5" which has come from the card is guided towards crosslapper infeed belt 7", itself having a return roller 8".

Web 5" is then processed in the crosslapper, and in particular rolled in the form of lateral sections, one towards the other, in order to form a nonwoven web when exiting the crosslapper.

The web is transported between card outfeed belt 1" and crosslapper infeed belt 7" by a drafting roller 10" rotated by a motor controlled by a control system for modifying the rotational speed of drafting roller 10" for drafting more or less the card web as needed, and in particular to regulate the lateral thickness profile of the batt formed at the exit of the crosslapper.

Return roller 3" of the card belt rotates substantially at a constant speed, whereas drafting roller 10" has a variable peripheral speed as a function of time, in particular periodically, which is greater than that of card outfeed belt 1", in order thus to achieve a drafting of web 5", the drafted web entering into the crosslapper numbered 9" in FIG. 4. Infeed belt 7" moves forward at a speed substantially equal to that of drafting roller 10". However, it is likewise possible to provide application of a slight drafting (from 1 to 10% in particular) between roller 10" and infeed belt 7", the tension caused by this auxiliary drafting increasing the control of the web during transfer from roller 10" to belt 7".

The path of the web 5" between upper outfeed belt 1" and crosslapper infeed belt 7" is such that it passes over a portion of the lower surface of roller 10", in particular over an angle sector of between 60° and 100°.

Roller 10" is in suction mode in order to help web 5" to be guided between belt 1" and infeed belt 7" and to maintain same against the surface of roller 10" during drafting. In order to do this, a suction sector 18 linked to a ventilator, which is not shown, achieved in the depression at the interior of roller 10" to obtain the necessary depression to keep web 5" against the lower surface of roller 10".s The suction sector 18 and its associated ventilator are dimensioned such that the thickness of web 5" passing over the surface of roller 10" is not less than 50% of the thickness of web 5" directly upstream of the roller, preferably is not less than 75% of its thickness directly upstream of the roller, preferably is not less than 90%, even more preferably is substantially equal to the thickness directly upstream of the roller and even more preferably is equal to its thickness directly upstream of roller 10", in particular the suction sector 18 and its associated ventilator are dimensioned in order to create, for a web density area of between 20 and 100 g/m$^2$, in particular between 30 and 80 g/m$^2$, a depression of between 10 millibars and 100 millibars, in particular of between 40 and 70 millibars.

At the exit of belt 1", web 5" comes into contact with the lower surface of roller 10" and moves along this surface towards the infeed belt 7" of the crosslapper.

The interstice between roller 10" and belt 1" is greater than the thickness of web 5", such that no pinching force is exerted on web 5" in terms of this interstice. In particular, this interstice can be between 5 and 20 mm, for example between 7 and 15 mm for a web density area of between 10 and 50 g/m$^2$, preferably between 20 and 40 g/m$^2$.

The interstice between roller 10" and roller 8" is greater than the thickness of web 9", such that there is no pinching force exerted on web 9" in terms of this interstice.

A suction chamber 16 linked to a ventilator, which is not shown, is also arranged at the level of belt 1" in order to ensure auxiliary maintenance by suction of the web 5" against a portion of the upper surface of belt 1". The suction chamber 16 is arranged such that the thickness of 5" downstream of the ventilator is not less than 50% of the thickness of 5" directly upstream of box 16, preferably is not less than 75% of its thickness directly upstream of box 16, preferably is not less than 90%, even more preferably is substantially equal to the thickness directly upstream of box 16 and even more preferably is equal to its thickness directly upstream of box 16. In particular, the suction chamber 16 and its associated ventilator are dimensioned in order to create, for an area density of web 5" of between 20 and 100 g/m$^2$, in particular between 30 and 80 g/m$^2$, a depression of between 10 millibars and 100 millibars, in particular of between 40 and 70 millibars.

FIG. 4 shows a fourth embodiment of a facility according to the invention.

A card produces a web 50 of nonwoven fibres exiting the card by a card outfeed belt 100. Card outfeed belt 100 comprises a return roller 30 rotating at a substantially constant speed. Web 50 which has come from the card is guided towards crosslapper infeed belt 70, itself having a return roller 80.

Web 50 is then processed in the crosslapper, and in particular rolled in the form of lateral sections, one towards the other, in order to form a nonwoven web when exiting the crosslapper.

The web is transported between card outfeed belt 100 and crosslapper infeed belt 70 by a drafting roller 110 rotated by a motor controlled by a control system for modifying the speed of continuous belt 110 for drafting more or less the card web as needed, and in particular to regulate the lateral thickness profile of the batt formed at the exit of the crosslapper.

Figure 5:
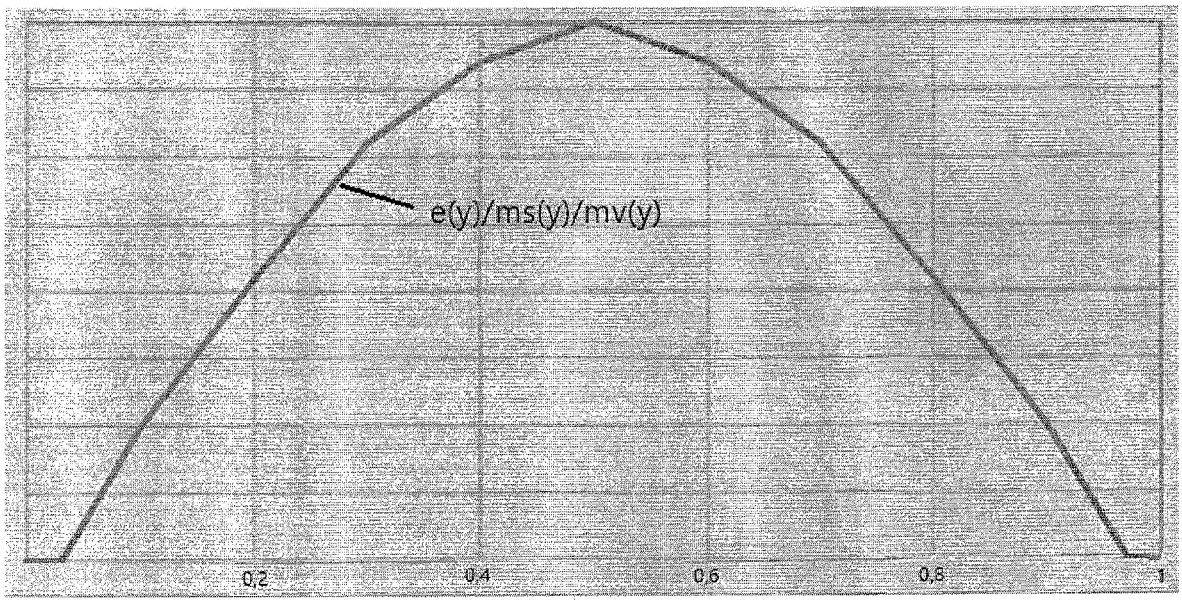
FIG. 5 represents an example of profile or distribution of thickness e(y), respectively ms(y), respectively mv(y), where y is the standardised ordinate (i.e. the ordinate divided by the size of the batt) between 0 and 1 in direction CD of the batt exiting the lapper.

Return roller 30 of the card belt rotates substantially at a constant speed, whereas continuous belt 110 has a variable peripheral speed as a function of time, in particular periodically, which is greater than that of card outfeed belt 100, in order thus to achieve a drafting of web 50, the drafted web entering into the crosslapper numbered 90 in FIG. 5. Infeed belt 70 moves forward at a speed substantially equal to that of continuous belt 110. However, it is likewise possible to provide application of a slight drafting (from 1 to 10% in particular) between continuous belt 110 and infeed belt 70, the tension caused by this auxiliary drafting increasing the control of the web during transfer from continuous belt 110 to belt 70.

The path of the web between upper outfeed belt 100 and crosslapper infeed belt 70 is such that it passes over a portion of the lower surface of continuous belt 110.

Continuous belt 110 is in suction mode in order to help the web to be guided between belt 100 and belt 70 and to maintain same against the surface of roller 110 during drafting. In order to do this, a suction chamber 111 linked to a ventilator, which is not shown, achieved in the depression at the interior of continuous belt 110 to obtain the necessary depression to keep the web against the lower surface of continuous belt 110. The suction chamber 111 and its associated ventilator are dimensioned such that the thickness of web 50 passing over the surface of continuous belt 110 is not less than 50% of the thickness of web 50 directly upstream of the continuous belt, preferably is not less than 75% of its thickness directly upstream of the continuous belt preferably is not less than 90%, even more preferably is substantially equal to the thickness directly upstream of the continuous belt and even more preferably is equal to its thickness directly upstream of continuous belt 110. In particular, the suction chamber 111 is arranged in order to create, for an area density of the web of between 20 and 100 g/m$^2$, in particular between 30 and 80 g/m$^2$, a depression of between 10 millibars and 100 millibars, in particular of between 40 and 70 millibars.

At the exit of belt 100, web 50 comes into contact with the lower surface of continuous belt 110 and moves along this surface towards the infeed belt 70 of the crosslapper.

The interstice between continuous belt 110 and belt 100 or roller 30 is greater than the thickness of web 50, such that there is no pinching force exerted on web 50 in terms of this interstice. In particular, this interstice can be between 5 and 20 mm, for example between 7 and 15 mm for a web density area of between 10 and 50 g/m$^2$, preferably between 20 and 40 g/m$^2$.

The interstice between continuous belt 110 and belt 70 or roller 80 is greater than the thickness of web 90, such that there is no pinching force exerted on web 90 in terms of this interstice.

For another thing, there is provided in the web forming device, upstream of belts 1, 2; 1'; 1"; 100 (exit), a card drive 20 guided by a motor 21 and supplied by a supply 22 guided by a motor 23. Two doffers 24 and 25 made of cylinders or rotating rollers are guided by respective motors and collect, by a suitable trim, a part of the rotating fibres by drum 20 in order to form, with these fibres, respective elementary webs 5, 6; 5'; 5"; 50. Before arriving at the outfeed belts, the elementary webs are taken over by two condensing cylinders 27, 28 and a respective stripping cylinder 29*a*, 29*b*.

Control unit 60 is linked to different motors guiding the different elements of the web production device, in particular the motors guiding the supply, the drum, the doffers, the strippers, the condensers and the outfeed belts.

By means of unit 60, it is possible to vary, as a function of time, in particular periodically, in order to correspond to a depositing path of a section of the batt exiting the crosslapper, the thickness and/or the area densities and/or bulk densities of the web exiting the outfeed belts, by accelerating or slowing down the rotation speeds of the doffer rollers. The speeds of the elements of the web production facility downstream of the doffers, i.e. the stripping rollers and condensers and rollers 3, 4; 3', 4'; 3"; 30 of the outfeed belts, are controlled so as to be at the same speed as that of the doffer rollers, such that the thickness profiles and/or area densities and/or bulk densities of the elementary webs created by variation of the speed of the doffers are transmitted without modification as far as drafting roller 10; 10'; 10"; 100.

On the basis of these first variation means, there would be obtained, if the downstream drafting roller was regulated in order not to carry out any drafting, a first periodic distribution or law $V\mathbf{1}_x(t)$ of the speed of the doffer rollers, the effect of which is to create the desired lateral thickness distribution (x/100).e(y) and/or area density (x/100).ms(y) and/or bulk density (x/100).mv(y) of the batt exiting the crosslapper.

On the basis of variations in speed of the drafting roller, if the speeds of the doffers remain constant, there would likewise be obtained a second distribution or law $V\mathbf{2}_x(t)$ of the speed of the drafting roller, the effect of which is to create the desired lateral distribution of thickness (1-x/100).e(y) and/or area density (1-x/100).ms(y) and/or bulk density (1-x/100).mv(y) of the batt exiting the crosslapper.

The two variations are carried out in combination and in synchronisation, the first distribution created by varying the speed of the doffers being completed by the second distribution created by varying the drafting of the web by the drafting roller, the combination of these two variations making it possible to obtain a very good quality of batt, the quality being able to be in particular defined by the level of correspondence between the provided batt vis-à-vis the desired batt, in particular in terms of lateral or CD distribution of the thickness, area density and or bulk density. In particular, due to the combined implementation of the two variations, it is possible to reduce the variability of speed at the entry of the crosslapper vis-à-vis the average speed, in particular the maximum or peak speed at the entry of the crosslapper and/or at the exit of the crosslapper as well as the acceleration at the entry of the crosslapper and/or at the exit of the crosslapper, such that the batt, being subjected to fewer strikes, is more homogeneous and comprises fewer local faults, for a given production speed, or for a same quality of batt; thus the production speed can be increased.

According to an embodiment, for a given x (in %) and a given distribution e(y), ms(y), mv(y), it is possible to calculate firstly laws of speed of different elements of the line, without applying two variations. On the basis of the unwound internal length Ldi of the lapper which makes it possible to define the periodicity in the time of periodic variations (course of the lapping wagon), the second drafting law of the web (speed $v\mathbf{2}_x(t)$ of rotation of the drafting roller) is calculated and applied in order to obtain the distribution or desired law (1-x/100).e(y) or (1-x/100).ms(y) or (1-x/100).mv(y) provided for the batt to advance.

Then, the unwound length Ldc of the card between two respective application points P1 and P2 of the two variations on the line is calculated by integrating the elementary movement along the line corresponding to the law $V\mathbf{2}_x(t)$ between the points P1 and P2 in order thus to obtain the curve giving the length Ldc(t) as a function of time and the first regulating means regulate the speed $V\mathbf{1}_x(t)$ of the doffers as a function of Ldc(t), in order thus to obtain, at the exit of the lapper, the desired profile at the advance e(y)/ms(y)/mv(y) but which is thus the result of a combination of laws $V\mathbf{1}_x(t)$ and $V\mathbf{2}_x(t)$ each corresponding, independently of one another, to x %, respectively (100-x) %, of the desired final profile.

Preferably, the proportion x of the desired given profile at the advance created by varying the speed of the doffers is between 20% and 80%, in particular between 30% and 70%, the sum of the proportions of the profile created respectively by the speed of the doffer(s) and the speed of the drafting roller being 100%.

According to a first example, for an average infeed speed 130 of m/mn, a batt size of 7.4 m, a unwound lapper length of 13.40 m and an unwound card length of 4.10 m, if there is a provision of a ratio of 0.64/0.36 (64%/36%) in favour of the action on the doffers, there is thus obtained a maximum lapper infeed speed of 142.3 m/mn (cf. a maximum infeed speed in the case of profiling carried out solely by the drafting roller of 156.2 m/mn and a maximum infeed speed in the case of a profiling carried out solely by the doffers of 160.6 m/mn) and a maximum output speed of 160.9 m/mn (cf. a maximum outfeed speed in the case of a profiling carried out solely by the drafting roller of 178.8 m/mn and a maximum outfeed speed in the case of a profiling carried out by the doffers of 180.2 m/mn). The maximum acceleration is thus from 6.42 m/s$^2$ exiting the lapper and 0.7 m/s$^2$ entering the napper (cf. a maximum outfeed acceleration in the case of a profiling carried out solely by the drafting roller of 10.16 m/s$^2$ and a maximum outfeed speed in the case of a profiling carried out solely by the doffers of 7.04 m/s$^2$ and at a maximum infeed acceleration in the case of a profiling carried out solely by the drafting roller of 0.9 m/s$^2$ and a maximum infeed acceleration in the case of a profiling carried out solely by the doffers of 0.7 m/s$^2$).

According to a second example, for an average infeed speed of 130 m/mn, a batt size of 7.4 m, an unwound length of the tapper of 13.40 m and an unwound card length of 4.10 m, if there is provided a ratio of 0.5/0.5 (50%150%) of the actions of the doffers and of the drafting roller, there is thus obtained a maximum infeed speed of the lapper of 135.7 m/mn (cf. a maximum infeed speed in the case of a profile carried out solely by the drafting roller of 156.2 m/mn and a maximum infeed speed in the case of a profiling carried out solely by the doffers of 160.6 m/mn) and a maximum outfeed speed of the lapper of 153.9 m/mn (cf. a maximum outfeed speed in the case of a profiling carried out solely by the drafting roller of 178.8 m/mn and a maximum infeed speed in the case of a profiling carried out solely by the doffers of 180.2 m/mn). The maximum acceleration is thus 7.18 $m/s^2$ exiting the lapper and 0.5 $m/s^2$ entering the lapper (cf. a maximum outfeed acceleration in the case of a profiling carried out solely by the drafting roller of 10.16 $m/s^2$ and a maximum outfeed acceleration in the case of a profiling carried out solely by the doffers of 7.04 $m/s^2$ and a maximum infeed acceleration in the case of a profiling carried out solely by the drafting roller of 0.9 $m/s^2$ and a maximum infeed acceleration in the case of a profiling carried out by the doffers of 0.7 $m/s^2$).

Moreover, it is self-evident that the different embodiments described in the figures can be combined, and in particular a feature provided in one thereof can be incorporated in each of the other embodiments described without having to be incorporated in this new embodiment, made of the combination of one of said other embodiments and the thus-incorporated feature, would be only one of all the other features of the embodiment from which said feature has been taken.

Thus, for example, it is possible to provide the embodiments of FIGS. 1, 2 and 4 the auxiliary suction described in FIG. 3. According to another example, there can be provided in the embodiments of FIGS. 2, 3 and 4 two card outfeed belts as provided and represented in FIG. 1.

In FIG. 5, a profile e(y) or ms(y) or mv(y) is represented, with the aim of obtaining at the exit of the crosslapper giving the speed of variation along the size of the batt of the thickness of the area density or the bulk density as a function of the ordinate in standardised size y of between 0 and 1. This profile has an inverted U-shape, the value of e(y), respectively ms(y), respectively mv(y), being greatest at the centre and least at the edge, with a differential of 40%. Thus, the greatest value e(y=0.5), ms(y=0.5), respectively mv(y=0.5) is equal to 140% of the value e(y=0 or 1), respectively ms (y=0 or 1), respectively mv(y=0 or 1).

For a given x, the action of the second control means (no drafting at the level of the drafting roller) is expunged, and the first control means (action of the doffer(s)) is regulated according to a periodic curve V1$x$(t) for varying the speed of the doffers so as to obtain a profile (x/100).e(y), respectively (x/100).ms(y), respectively (x/100).mv(y). The aim of varying the speed of the doffers is to vary the thickness/area density/bulk density of the web deposited on the card outfeed belts.

Then, the action of the first control means (no relative movement of the doffers) is expunged, and the second control means (action of the drafting roller) is regulated according to a curve of varying the period speed V2$x$ (t) of the drafting roller in order to obtain a profile (1-x/100).e(y), respectively (1-x/100).ms(y), respectively (1-x/100).mv(y).

Then, the two determined adjustments V1$x$(t) and V2$x$ (t) are applied, after having been synchronised such that the actions add up, in order thus to obtain the desired profile e(y), ms(y) or mv(y).

Thus the maximum infeed speed, the maximum infeed acceleration, the maximum deposition speed and the maximum infeed acceleration of the lapper and at the deposition for each value of x and tracing the corresponding curves of these speeds and accelerations as a function of x can be collected. The existence of an optimal value of x corresponding to the optimal function is noted, i.e. the minimal V max speeds and the minimal Acc max accelerations.

For example, for an average infeed speed of 110.00 m/mn, a batt size of 6.0 m, an acceleration distance of 0.6 m, an unwound lapper length of 13.40 m and an unwound card length of 4.1 m, there is found an optimum for x=53%, with the corresponding values in the table below

| Infeed data: | |
|---|---|
| Average infeed speed | 110.00 m/mn |
| Batt size | 6.00 m |
| Acceleration distance | 0.60 m |
| Unwound lapper length | 13.40 m |
| Unwound card length | 4.10 m |

Results:

| | Infeed | | Deposit | |
|---|---|---|---|---|
| | Vmax m/mn | Acc max $m/s^2$ | Vmax m/mn | Acc max $m/s^2$ |
| Doffer(s) only | 135.9 | 0.7 | 153.8 | 10.90 |
| Scutcher roll only | 132.2 | 0.8 | 146.9 | 8.80 |
| Doffer 53% + roller 47% | 119.7 | 0.6 | 132.5 | 7.90 |

Internal unwound lapper length (Ldi) means the length of the unwound web between the central point (P2) of the variable drafting zone (drafting roller) and the depositing point of the web on the crosslapper outfeed belt (not shown in the figures).

Unwound card length (Ldc) means the length of the unwound web between the point (P1) for forming the web and the central point (P2) of the variable drafting zone (drafting roller).

The invention claimed is:

1. A facility forming a fibre batt, comprising a production device for producing at least one fibre web made of fibres, and a crosslapper supplied in the at least one fibre web and providing, at an exit, the fibre batt, the production device comprising a carding drum and at least one doffer roller collecting the fibres on the carding drum and supplying the at least one fibre web to at least one outfeed belt located downstream of said production device, the crosslapper having an infeed belt, on which the at least one fibre web is placed for introduction of said at least one fibre in the crosslapper, the crosslapper supplying, at the exit, the fibre batt formed of a stack of layers of the at least one fibre web, and control means controlling a profile of a thickness and/or an area bulk density and/or a bulk density of the at least one fibre web as a function of time during the forming of the fibre batt, at a point of the at least one fibre web in the web production device, characterized by drafting means arranged so as to draft said at least one fibre web downstream of the at least one outfeed belt and upstream of the infeed belt of the crosslapper.

2. The facility according to claim 1, characterized in that the control means control a relative rotational speed of the at least one doffer in respect of the carding drum.

3. The facility according to claim 2, characterized in that the relative movement speed of the at least one outfeed belt in respect of the carding drum is equal or substantially equal to a peripheral speed of the at least one doffer.

4. The facility according to claim 1, characterized in that the production device for forming the at least one web comprises, in addition to the carding drum and the at least one doffer, one or more condenser rollers and one or more stripping rollers, and a rotational speed thereof is synchronized with a rotational speed of the at least one doffer and with a rotational speed of the at least one outfeed belt.

5. The facility according to claim 1, characterized in that the drafting means are made of a drafting roller, a rotational speed of the drafting roller is controlled in order to achieve variation in the drafting as a function of time.

6. The facility according to claim 1, characterized in that the journey of the at least one web between said outfeed belt of the production device, downstream of the at least one doffer, and the infeed belt of the crosslapper comprises at least one inflection point.

7. The facility according to claim 1, characterized in that the drafting means comprise a drive element of the at least one web comprising a drive surface intended to come into contact with the at least one web for driving same, the speed of the drive element being controlled to achieve variation in the drafting as a function of time, and a suction device for achieving suction at the drive surface is provided to maintain, by suction, the at least one web against the drive surface.

8. The facility according to claim 1, characterized in that the drafting means comprise a drive element of the at least one web comprising a drive surface intended to come into contact with the at least one web for driving same, the speed of the drive element being controlled to achieve variation in the drafting as a function of time.

9. The facility according to claim 1, characterized in that the production device includes two outfeed belts, respectively an upper outfeed belt and a lower outfeed belt, two upper and lower webs converging upstream of the drafting means.

10. The facility according to claim 7, wherein the drive element is a drafting roller.

11. The facility according to claim 8, wherein the drive element is a drafting roller.

12. The facility according to claim 9, wherein the two upper and lower webs converge upstream of the drafting roller.

13. The facility according to claim 1, wherein said control means are configured so as to control drafting means so as to cause variation in the drafting as a function of time.

14. The facility according to claim 13, wherein the action of said control means on said profile in said production device and on said drafting means are synchronized.

15. A facility for forming a fibre batt, comprising a production device for producing at least one fibre web made of fibres, and a crosslapper supplied in the at least one fibre web and providing, at an exit, the fibre batt, the production device comprising a carding drum and at least one doffer roller collecting the fibres on the carding drum and supplying the at least one fibre web to at least one outfeed belt, the crosslapper having an infeed belt, on which the at least one fibre web is placed for introduction of said at least one fibre in the crosslapper, the crosslapper supplying, at the exit, the fibre batt formed of a stack of layers of the at least one fibre web, and control means controlling a profile of a thickness and/or an area bulk density and/or a bulk density of the at least one fibre web as a function of time during the forming of the fibre batt, at a point of the at least one fibre web in the web production device, characterized by drafting means arranged so as to draft said at least one fibre web downstream of the at least one outfeed belt and upstream of the infeed belt of the crosslapper.

16. A facility for forming a fibre batt, comprising a production device for producing at least one fibre web made of fibres, and a crosslapper supplied in the at least one fibre web and providing, at an exit, the fibre batt, the production device comprising a carding drum and at least one doffer roller collecting the fibres on the carding drum and supplying the at least one fibre web to at least one outfeed belt, the crosslapper having an infeed belt, on which the at least one fibre web is placed for introduction of said at least one fibre in the crosslapper, the crosslapper supplying, at the exit, the fibre batt formed of a stack of layers of the at least one fibre web, and control means controlling a profile of a thickness and/or an area bulk density and/or a bulk density of the at least one fibre web as a function of time during the forming of the fibre batt, at a point of the at least one fibre web in the web production device at the at least one doffer, characterized by drafting means arranged so as to draft said at least one fibre web downstream of the at least one outfeed belt and upstream of the infeed belt of the crosslapper.

* * * * *